US005201079A

United States Patent [19]

Sowards

[11] Patent Number: 5,201,079

[45] Date of Patent: Apr. 13, 1993

[54] TOILET VENTILATION SYSTEM

[76] Inventor: Edward W. Sowards, 160 Ridge Rd., Ben Lomond, Calif. 95005

[21] Appl. No.: 764,635

[22] Filed: Sep. 24, 1991

[51] Int. Cl.[5] ..... E03D 9/04

[52] U.S. Cl. ..... 4/216; 4/213

[58] Field of Search ..... 4/213, 214, 215, 216, 4/217, 348, 349, 350, 351, 352

[56] References Cited

U.S. PATENT DOCUMENTS

| | | | |
|---|---|---|---|
| 2,203,111 | 6/1940 | Stebbing et al. | 4/213 |
| 2,452,282 | 10/1948 | Auer | 4/213 |
| 2,575,778 | 11/1951 | Wilson | 4/213 |
| 4,318,192 | 3/1982 | Williams et al. | 4/213 |
| 4,864,664 | 9/1989 | Higgins | 4/213 |
| 4,933,996 | 6/1990 | Sowards | 4/213 |

FOREIGN PATENT DOCUMENTS

| | | | |
|---|---|---|---|
| 0038668 | 1/1907 | Switzerland | 4/216 |
| 8002577 | 11/1980 | World Int. Prop. O. | 4/213 |

*Primary Examiner*—William A. Cuchlinski, Jr.
*Assistant Examiner*—W. Morris Worth
*Attorney, Agent, or Firm*—Jacobson, Price, Holman & Stern

[57] ABSTRACT

A ventilation system is provided including a blower assembly mounted within the air space in the upper portion of a toilet flush tank, which air space is communicated with the upper and interior portion of the associated toilet bowl through an overflow pipe disposed in the water tank, and the blower assembly includes an inlet opening into the air space and a air outlet with which the inlet end of conduit structure is sealingly communicated. The conduit structure extends downwardly through the interior of the flush tank, out through the bottom of the flush tank and then downwardly into the base of the toilet bowl through an individual passage formed therein with the outlet end of the passage opening lengthwise outwardly through one peripheral wall portion of a thick-walled outlet nipple for the discharge outlet from the toilet bowl, the bottom wall of the toilet flush tank being spaced above and underlying top wall portion of the toilet base and the spacing between the flush tank bottom wall and toilet base being bridged by a sleeve telescoped into diametrically enlarged adjacent ends of the corresponding passage sections. The intermediate length portion of the sleeve includes a resilient seal ring disposed thereabout and compressed between the bottom of the tank and the upper surface of the toilet base.

3 Claims, 1 Drawing Sheet

TOILET VENTILATION SYSTEM

BACKGROUND OF THE INVENTION

1. Field of the Invention

A ventilation system is provided including a blower assembly mounted within the air space in the upper portion of a toilet flush tank, which air space is communicated with the upper interior portion of the associated toilet bowl through an overflow pipe disposed in the toilet flush tank, and the blower assembly includes an air inlet opening into the air space and an air outlet with which the inlet end of conduit structure is sealing communicated. The conduit structure includes an inlet end portion formed integrally with the rear wall of the toilet flush tank and an outlet portion thereof formed integrally with the base of the associated toilet (which base defines the toilet bowl). The inlet end portion of the conduit structure opens downwardly through the bottom of the flush tank in vertically spaced relation above and registered with the outlet end of the conduit structure. The latter opens upwardly through the rear portion of the toilet base and seal structure is disposed between the bottom of the toilet flush tank and the toilet base sealingly communicating the inlet and outlet end portions of the conduit structure. The base of the toilet includes a thick-walled tubular outlet neck for registry and sealed communication with the inlet end of an associated soil pipe and the outlet end portion of the conduit means opens downwardly through the rear peripheral portion of the tubular outlet neck between the inner and outer walls thereof. Communication structure communicates the outlet of the blower assembly with the inlet end of the conduit structure in sealed relation therewith and includes a one way air flow controlling valve normally biased to a closed position to prevent reverse flow of air through the conduit structure from the tubular outlet neck of the toilet to the blower structure and is openable, responsive to operation of the blower assembly and the resultant increase in air pressure within the communicating structure upstream from the valve, to allow the flow of air from the outlet of the blower assembly, through the communication structure and thereafter downwardly through the conduit structure for discharge from the tubular outlet neck of the toilet base.

2. Description of Related Art

My prior U.S. Pat. No. 4,933,996 discloses a toilet deodorizer which includes the basic structure of the instant invention, but which utilizes an exterior ventilation pipe and a solenoid valve serially connected therein adjacent the outlet end of the ventilation pipe which opens into the outlet siphon passage of the toilet base.

However, this exterior structure is objectionable to some persons and I have found that it is more economically feasible and more desirable from an aesthetic standpoint to build the ventilation passage into the rear wall structure of the flush tank and the rear portion of the base of the toilet.

SUMMARY OF THE INVENTION

The toilet ventilation system of the instant invention operates to vent, through the utilization of a blower assembly, the air space within the upper portion of a toilet flush tank to the outlet for the toilet bowl downstream from the water check or seal of the toilet bowl, the air space in the upper portion of the toilet flush tank being communicated with the air space within the toilet bowl above the water level therein by the usual overflow pipe for the water flush tank defining the uppermost water level therein. The inlet for the blower assembly is communicated with the air space within the water tank and the outlet of the blower assembly is communicated, by conduit means, with the terminal outlet end of the tubular outlet nipple of the toilet bowl base, the tubular outlet nipple being of thick-walled construction and the conduit means passing axially along the tubular outlet nipple through one peripheral portion thereof between the inner and outer walls of the nipple. This locates the outlet for the conduit means well downstream from the siphon portion of the toilet bowl outlet and, therefore, the induction of ventilated air into the soil pipe with which the tubular outlet nipple is communicated does not function to break the siphoning action of the toilet bowl when it is flushed.

The main object of this invention is to provide a toilet bowl ventilation system for venting odorous air from within the toilet bowl, through the overflow pipe of the associated water flush tank and thereafter outwardly of the extreme discharge end of the tubular discharge nipple of the toilet bowl base.

Another object of this invention, in accordance with the immediately preceding object, is to provide a toilet bowl ventilating system using a motor driven blower assembly for accomplishing the desired ventilation operation and wherein communication between the above mentioned overflow and the toilet bowl outlet is terminated during periods of non-use of the blower assembly.

Another very important object of this invention, in accordance with the preceding objects, is to provide an electrical control for the blower assembly such that the blower assembly is operated only in response to weight of a predetermined value applying downward pressure on the seat of the toilet bowl.

A further object of this invention is to provide a toilet bowl ventilation system which may be readily incorporated into the manufacture of new toilets and toilet flush tanks.

Still another object of this invention is to provide a toilet bowl ventilating system which may be designed for usage with conventional 110 V household current or a selected DC voltage, such as 6 or 12 volt current, as desired.

Another very important object of this invention is to provide a toilet ventilation system incorporated entirely within the flush tank and base of the toilet so as to be totally unobtrusive.

A final object of this invention to be specifically enumerated herein is to provide a toilet ventilation system in accordance with the preceding objects and which will conform to conventional forms of manufacture, be of simple construction and fully automatic in operation so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
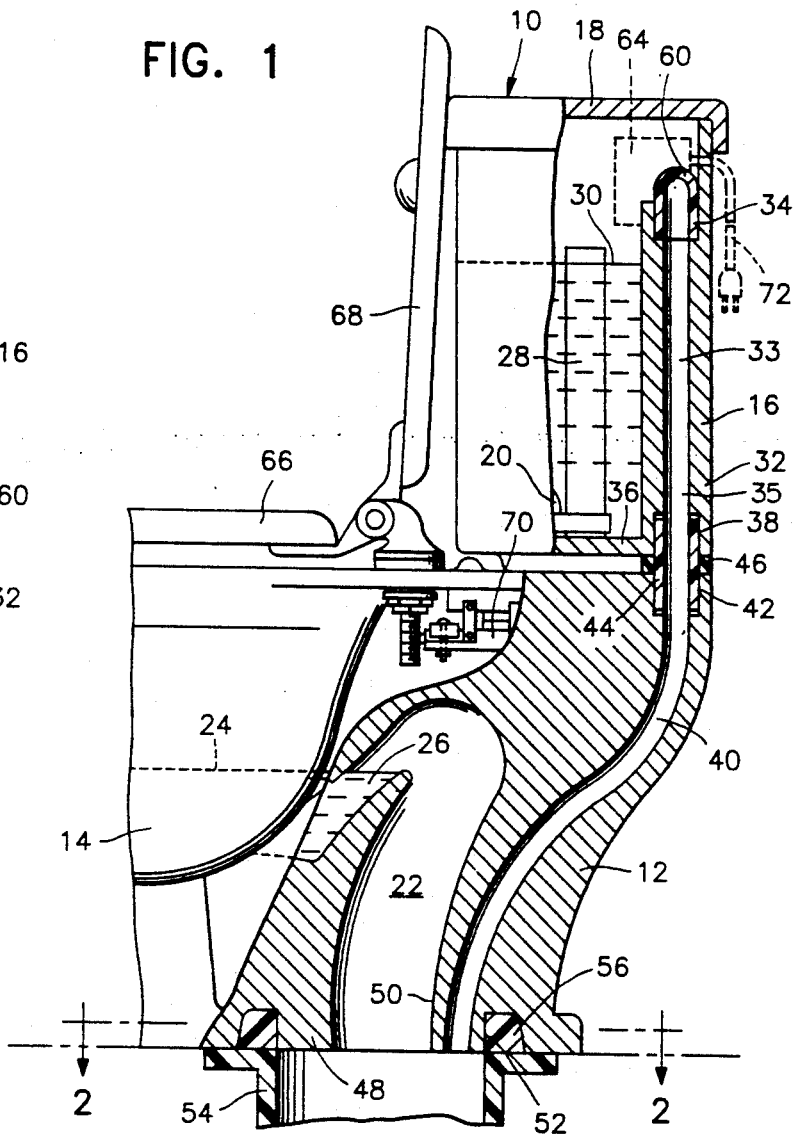
FIG. 1 is a fragmentary side elevational view of a conventional toilet having portions thereof being broken away and illustrated in vertical section in order to illustrate the manner in which the ventilation system of the instant invention is incorporated within the flush tank and bowl base of the toilet.
Figure 3:
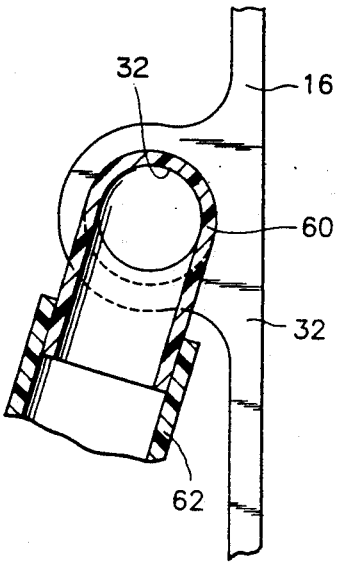
FIG. 3 is an enlarged fragmentary top plan view of the central portion of the rear wall of the flush tank of the toilet illustrating the ventilation passage formed therein and with an adjacent portion of the communication structure by which the blower discharge is communicated with the ventilation passage illustrated in horizontal section.
Figure 2:
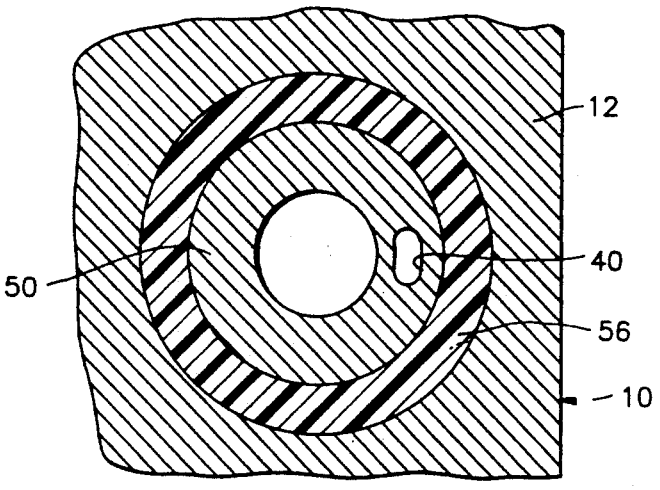
FIG. 2 is an enlarged fragmentary horizontal sectional view taken substantially upon the plane indicated by the section line 2—2 of FIG. 1.

Referring now more specifically to the drawings, the numeral 10 generally designates a basically conventional toilet assembly including a base 12 incorporating a bowl 14 and a flush tank 16 removably supported upon the rear of the base 12 and equipped with a removable top 18.

As is conventional, the toilet 10 includes a flushing mechanism 20 by which water within the tank 16 may be released therefrom into the upper portion of the interior of the bowl 14 for flushing the latter, the bowl 14 including a siphon-type outlet 22 therefor and a normal water level 24 defining a water check or seal 26 between the interior of the bowl above the level 24 and the outlet 22. In addition, the toilet 10 includes an overflow pipe 28 within the tank 16 through which excess water admitted into the tank 16 may be discharged into the interior of the bowl 14 and subsequently past the water seal 26 and out the outlet 22, there also being included in the flushing mechanism 20 conventional float control means (not shown) for supplying water to the tank 16 and terminating the supply of water to the interior of the tank 16 upon the water reaching the predetermined level 30 thereof below the top of the overflow or tube 28.

The rear wall 32 of the tank 16 has the inlet end portion 33 of a conduit passage 35 formed therein with the upper terminal inlet end being diametrically enlarged as at 34. The lower end of the inlet end portion 33 of the conduit passage 35 opens downwardly through the bottom wall 36 of the flush tank 16 and is also diametrically enlarged as at 38.

The rear portion of the base 12 includes the outlet end portion 40 of the conduit passage formed therein and the upper end thereof is diametrically enlarged as at 42 and opens upwardly through the rear upper surface of the base 12 in alignment with the inlet end portion 33 of the conduit passage.

The opposite ends of a vertical connecting sleeve 44 are snugly received within the diametrically enlarged portions 38 and 42 and the longitudinal mid-portion of the connecting sleeve 42 includes a resilient seal ring 46 carried thereby in sealed engagement therewith and which is axially compressed between the under surface of the bottom wall 36 of the tank 16 and the upper surface of the rear of the base 12.

The base 12 includes the usual tubular outlet nipple 48 for the outlet 22 and the lower end of the outlet end portion 40 of the conduit passage extends downwardly, axially, through one peripheral portion of the tubular outlet nipple 48 between the inner and outer walls 50 and 52 thereof, the outlet nipple 48 being sealed relative to the flanged upper end of a soil pipe 54 through the utilization of a conventional wax seal ring 56 or the like.

The upper end of the inlet end portion 33 of the conduit passage has the outlet end 60 of a communicating duct 62 sealing secured therein and the inlet end (not shown) of the communicating duct 62 is sealing coupled to the outlet (not shown) of a blower assembly 64, the inlet of the blower assembly 64 opening into the interior of the flush tank 16 above the level 30 therein.

Further, the communicating duct 62 includes a one way check valve or flap valve member (not shown) similar to that designated at 86 in my prior U.S. Pat. No. 4,933.996. Also, the base 12 supports a toilet bowl seat 66 and cover 68 therefrom with the hinge mount for the seat 66 operatively associated with a control switch 70 corresponding to the similar control switch disclosed in my above mention prior patent and which is actuable in the manner also disclosed in my prior patent. Of course, the blower assembly 64 is actuable through a suitable extension cord 72 from any suitable source of electrical potential, the switch 70 being serially connected in the extension cord 72 between the plug thereof and the blower assembly 64.

All of the structure of the instant invention common to the similar structure disclosed in my above mentioned prior patent is to be considered as incorporated herein by reference thereto.

The basic difference between the instant invention and that disclosed in my prior U.S. Pat. No. 4,933,996 is that the ventilation passage receiving the discharge from the blower assembly 64 and discharging from the tubular outlet neck 48 is enclosed entirely within the tank and 16 and base 12. Further, the outlet end portion 40 of the communication passage opens downwardly and outwardly directly into the soil pipe 54 between the inner and outer walls 50 and 52 of the tubular outlet nipple 48 of the base 12. Otherwise, the structure and operation of the instant invention may be identical to that disclosed in my prior U.S. Pat. No. 4,933,996.

It will be noted that the sleeve 44 does not bottom in either diametrically enlarged portion 38 or 42 and that the toilet base 12 may be anchored to the floor upwardly through which the soil pipe 54 opens in a conventional manner.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A toilet of the type including a toilet bowl having a base for support from a floor, a water tank having a bottom and a water tank cover, said water tank including an overflow conduit whereby water in excess of a desired water level in said tank may be dispensed into said bowl and through which odorous air may be educted from said bowl into said tank above said level, said water tank also including a flushing mechanism whereby water may be discharged into said bowl from said tank to flush said bowl, and air space in said tank below said tank cover and above said desired water level, said toilet bowl including a predetermined water level and a siphon-type outlet below said water level with which said bowl water level coacts to form a water seal between said siphon-type outlet and the interior of said bowl, said siphon-type outlet opening downwardly from said base through a thick-walled tubular outlet nipple having inner and outer walls, the outer wall of said outlet nipple being adapted for sealed connection with a soil pipe with which said outlet nipple is registered through the use of a conventional seal, conduit means for providing a passage from said air space to said soil pipe including an outlet end portion extending through and opening downwardly from a predetermined portion of said tubular outlet nipple between the inner and outer walls thereof and an inlet end portion opening outwardly into said air space, blower means for drawing the odorous air out of said air space and forcing it into said conduit means, said blower means being mounted within said tank in said air space including an inlet opening into said air space and an outlet, communication means communicating said blower means outlet with said conduit means inlet end portion in sealed communication therewith, said communication means including pressure differential operated one way air flow controlling valve means for controlling the flow of odorous air, said valve means being normally biased to a closed position to prevent reverse flow of air from said conduit means outlet end portion through said conduit means, communication means and blower means into said air space and operable, responsive to operation of said blower means and the resultant increased upstream pressure from said blower means acting thereon, to allow the flow of air in a downstream direction through said communication means and said conduit means outwardly of said conduit means outlet end, said conduit means inlet end portion being disposed with said tank and opening downwardly though the bottom of said tank and said outlet portion of said conduit means being contained within said base, said inlet end portion of said conduit means being formed integrally with an upstanding wall of said tank and said base being spaced below the portion of said bottom through which said inlet end portion opens, said outlet portion opening upwardly from said base in alignment with said inlet end portion, seal means disposed between said bottom and base sealingly communicating said inlet and outlet end portions of said conduit means, aligned ends of said inlet end portion and said outlet end portion of said conduit means being diametrically enlarged, said seal means including a connecting sleeve extending between and snugly received in said diametrically enlarged adjacent ends, and a resilient seal ring disposed thereabout in sealed engagement with said sleeve and axially compressed between said bottom and base about said diametrically enlarged adjacent ends.

2. The toilet of claim 1 wherein the combined axial length of the diametrically enlarged aligned ends of said inlet end portion and said outlet end portion and the spacing between said bottom and base about said sleeve is greater than the length of said sleeve, the length of said sleeve being appreciably greater than the spacing between said bottom and base about said sleeve.

3. The toilet of claim 2 wherein said base includes a seal ring recessed upwardly thereinto immediately outwardly of said outer wall of said nipple for sealing said nipple to an upper end of a soil pipe with which said nipple is registered.

* * * * *